US008886094B2

(12) United States Patent
Koshizuka et al.

(10) Patent No.: US 8,886,094 B2
(45) Date of Patent: Nov. 11, 2014

(54) TONER SUPPLY DEVICE AND IMAGE FORMING APPARATUS

(75) Inventors: Shinnosuke Koshizuka, Kanagawa (JP); Hiroyuki Uenishi, Kanagawa (JP); Susumu Tateyama, Ibaraki (JP); Tatsuya Kubo, Kanagawa (JP); Akihiro Takayama, Kanagawa (JP); Kentaro Nodera, Kanagawa (JP); Emi Kita, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 135 days.

(21) Appl. No.: 13/587,184

(22) Filed: Aug. 16, 2012

(65) Prior Publication Data

US 2013/0051863 A1 Feb. 28, 2013

(30) Foreign Application Priority Data

Aug. 22, 2011 (JP) ..... 2011-180587

(51) Int. Cl.
*G03G 15/08* (2006.01)

(52) U.S. Cl.
CPC ..... *G03G 15/0886* (2013.01)
USPC ..... 399/258; 399/260

(58) Field of Classification Search
USPC ..... 399/107, 109, 110, 252, 258–263
See application file for complete search history.

(56) References Cited

U.S. PATENT DOCUMENTS

| | | | | |
|---|---|---|---|---|
| 8,126,373 | B2 * | 2/2012 | Utsunomiya et al. | 399/258 |
| 2006/0083552 | A1 | 4/2006 | Yoshimoto et al. | |
| 2006/0099012 | A1 | 5/2006 | Kita et al. | |
| 2007/0140747 | A1 | 6/2007 | Kita et al. | |
| 2009/0087214 | A1 | 4/2009 | Utsunomiya et al. | |
| 2011/0243579 | A1 | 10/2011 | Oshikawa et al. | |
| 2011/0305485 | A1 | 12/2011 | Oshikawa et al. | |

FOREIGN PATENT DOCUMENTS

| | | | |
|---|---|---|---|
| CN | 101398654 | A | 4/2009 |
| CN | 101867139 | A | 10/2010 |
| JP | 2009-086219 | | 4/2009 |
| JP | 2009-086220 | | 4/2009 |

OTHER PUBLICATIONS

Combined Office Action and Search Report issued Feb. 18, 2014 in Chinese Patent Application No. 201210290387.X (with English translation of category of cited documents).

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A toner supply device including a casing and a shutter member. The casing includes a toner container for containing toner, a discharge aperture for discharging the toner from the toner container, and an aperture. The shutter member includes an elastic part having at least one bending portion and the elastic part is elastically deformable. The shutter member is insertable into the casing through the aperture to be movable between a closed position at which the discharge aperture is closed and an opened position at which the discharge aperture is opened while the elastic part is kept elastically deformed.

9 Claims, 7 Drawing Sheets

TONER SUPPLY DEVICE AND IMAGE FORMING APPARATUS

CROSS-REFERENCE TO RELATED APPLICATIONS

This patent application is based on and claims priority pursuant to 35 U.S.C. §119 to Japanese Patent Application No. 2011-180587, filed on Aug. 22, 2011, in the Japanese Patent Office, the entire disclosure of which is hereby incorporated herein by reference.

BACKGROUND

1. Technical Field

The present disclosure relates to a toner supply device for use in image forming apparatuses such as copier, printer, facsimile machine, and multifunctional machines, and an image forming apparatus using the toner supply device.

2. Description of Related Art

In an electrophotographic image forming apparatus, an electrostatic latent image is formed on a photoreceptor and is developed into a toner image with toner particles supplied from a developing device. As the toner particles are consumed, a toner supply device supplies fresh toner particles to the developing device.

A toner supply device which is detachably attachable to an image forming apparatus is known. Upon attachment of a toner supply device to an image forming apparatus, a discharge aperture of the toner supply device is connected with a supply aperture of the developing device so that toner particles are supplied from the toner supply device to the developing device. Upon detachment of the toner supply device from the image forming apparatus, the discharge aperture is disconnected with the supply aperture. To prevent scatter of toner particles from the discharge aperture, the toner supply device may be equipped with a shutter member.

Japanese Patent Application Publication Nos. 2009-86219 and 2009-86220 each describe a toner supply device having a shutter member that is movable. FIG. 1 is a schematic view of a related-art toner supply device. A shutter member 200 is inserted into a casing 300 of a toner supply device through an aperture 600. When the shutter member 200 is in a position shown by two-dot chain lines in FIG. 1, a toner path 400 is closed with the shutter member 200 and toner particles in the casing 300 are prevented from discharging from a discharge aperture 500. When the shutter member 200 is in a position shown by solid lines in FIG. 1, the toner path 400 is opened and toner particles are dischargeable from the discharge aperture 500.

FIG. 2 is a plan view of the above related-art toner supply device in a state in which the shutter member 200 is inserted into the casing 300.

Upon insertion of the shutter member 200 in the casing 300, a pair of arm portions 220 of the shutter member 200 is brought into contact with inner surfaces of the casing 300 while elastically deforming from a shape shown by two-dot chain lines to that shown by solid lines. Since the pair of arm portions 220 is elastically deformable, the shutter member 200 can be easily inserted into the casing 300 without forming a gap between the shutter member 200 and an inner surface of the casing 300. As is not shown in FIG. 2 for the sake of simplicity, a seal member is stretched between the arms 220.

In a case in which the shutter member 200 is exposed to elastic deformation for a long period of time, the deformed portion may cause plastic deformation due to concentration of stress. As a result, the shutter member 200 may not sufficiently seal the casing 300.

SUMMARY

In accordance with some embodiments, a toner supply device is provided. The toner supply device includes a casing and a shutter member. The casing includes a toner container for containing toner, a discharge aperture for discharging the toner from the toner container, and an aperture. The shutter member includes an elastic part having at least one bending portion and the elastic part is elastically deformable. The shutter member is insertable into the casing through the aperture to be movable between a closed position at which the discharge aperture is closed and an opened position at which the discharge aperture is opened while the elastic part is kept elastically deformed.

In accordance with some embodiments, an image forming apparatus is provided. The image forming apparatus includes a latent image bearing member adapted to bear a latent image, a developing device adapted to develop the latent image into a toner image with toner, and the above toner supply device adapted to supply toner to the developing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
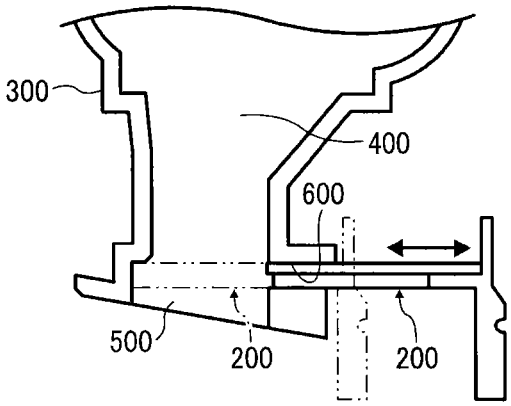
FIG. 1 RELATED ART
FIG. 1 is a schematic view of a related-art toner supply device.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Figure 3:
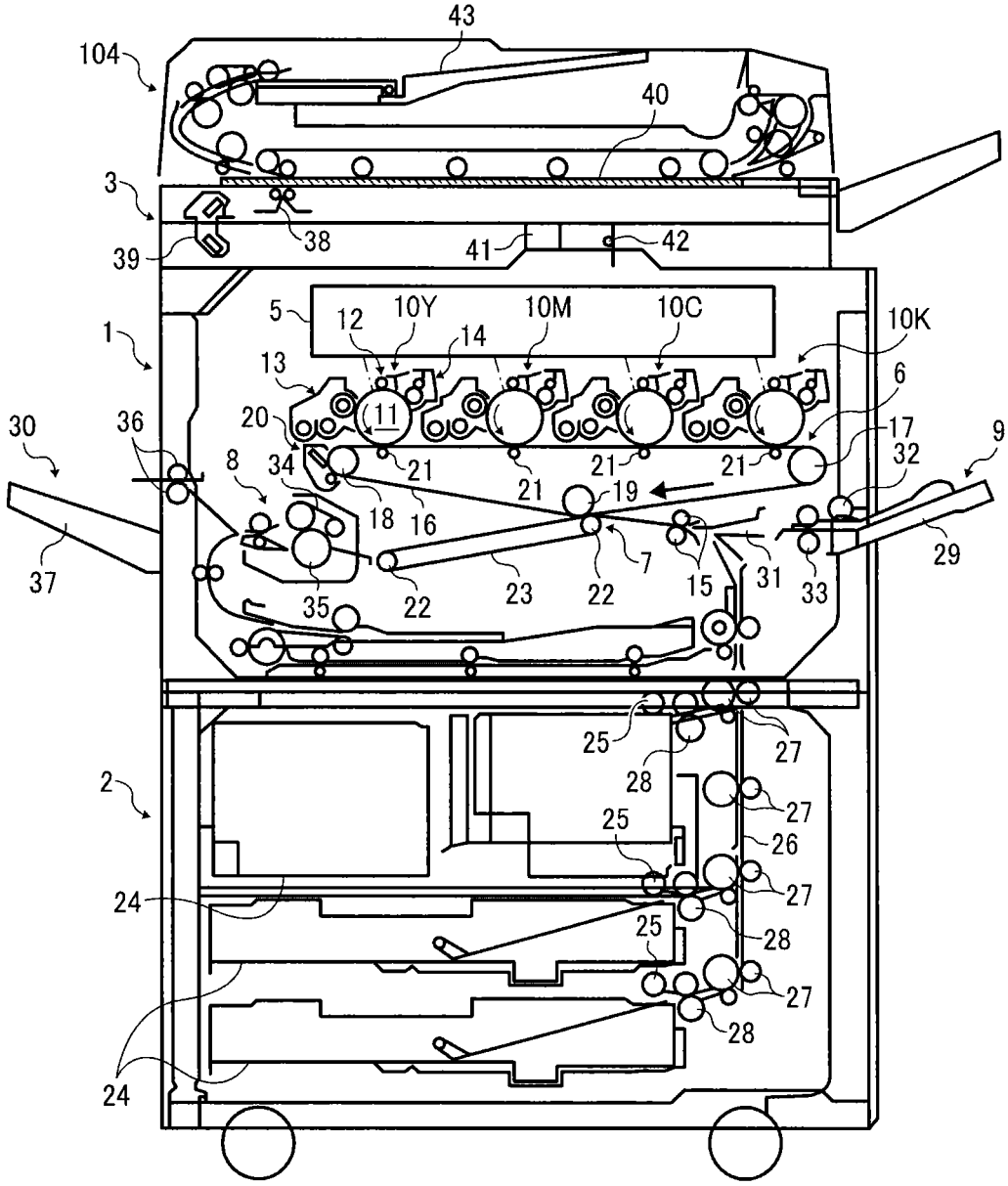
FIG. 3 is a schematic view of an image forming apparatus according to an embodiment.

FIG. 3 is a schematic view of an image forming apparatus according to an embodiment. This image forming apparatus is a full-color laser copier.

The image forming apparatus includes a printer 1, a paper feeder 2 disposed below the printer 1, a scanner 3 disposed above the printer 1, a paper ejector 30 disposed on a left side of the image forming apparatus in FIG. 3, and a manual paper feeder 9 disposed opposite to the paper ejector 30. An automatic document feeder 104 is disposed above the scanner 3.

The printer 1 includes four imaging units 10Y, 10M, 10C, and 10K that form images of yellow, magenta, cyan, and black, respectively. Each of the imaging units 10Y, 10M, 10C, and 10K has the same configuration as the others except for containing a toner of yellow, magenta, cyan, and black, respectively.

Each of the imaging units 10Y, 10M, 10C, and 10K includes a photoreceptor 11 serving as a latent image bearing member, a charger 12 that charges a surface of the photoreceptor 11, a developing device 13 that supplies toner particles to a latent image on the photoreceptor 11, a cleaner 14 that cleans a surface of the photoreceptor 11, and a neutralizer. In FIG. 3, for the sake of simplicity, reference numerals for the photoreceptor 11, charger 12, developing device 13, and cleaner 14 are illustrated only around the imaging unit 10Y.

The printer 1 includes an optical writing unit 5, an intermediate transfer unit 6, a secondary transfer device 7, and a fixing device 8.

The optical writing unit 5 includes a light source, a polygon mirror, an f-θ lens, and a reflective mirror. The optical writing unit 5 is adapted to emit laser light to a surface of the photoreceptor 11 based on image information.

The intermediate transfer unit 6 includes an intermediate transfer belt 16, a belt cleaner 20, a tension roller 17, a driving roller 18, a secondary transfer backup roller 19, and four primary transfer bias rollers 21. The intermediate transfer belt 16 is stretched taut across multiple rollers including the tension roller 17. The intermediate transfer belt 16 is rotatable clockwise in FIG. 3 as the driving roller 18 is driven to rotate by a driving motor.

Each of the four primary transfer bias rollers 21 presses against an inner peripheral surface of the intermediate transfer belt 16 at a position where the primary transfer bias roller 21 faces the respective photoreceptors 11. In each of these positions in which the primary transfer bias roller 21 presses against the intermediate transfer belt 16, the intermediate transfer belt 16 is brought into contact with the photoreceptor 11 and a primary transfer nip is formed therebetween. A place where two members meet and press against each other is a so-called nip. Each of the primary transfer bias rollers 21 is connected to a power source which supplies a predetermined direct current voltage (DC) and/or alternating current voltage (AC) thereto.

The secondary transfer device 7 includes a paper conveying belt 23 stretched taut by two tension rollers 22. The paper conveying belt 23 is rotatable counterclockwise in FIG. 3 as at least one of the tension rollers 22 rotates. The tension roller 22 on the right side in FIG. 3 and the secondary transfer backup roller 19 are sandwiching the intermediate transfer belt 16 and the paper conveying belt 23. Thus, the intermediate transfer belt 16 is brought into contact with the paper conveying belt 23 and a secondary transfer nip is formed therebetween. One of the tension rollers 22 is connected to a power source which supplies a predetermined direct current voltage (DC) and/or alternating current voltage (AC) thereto.

The paper feeder 2 includes multiple paper feed cassettes 24 for storing multiple sheets of a recording medium, e.g., paper. Each of the paper feed cassettes 24 has a paper feed roller 25 adapted to feed a top sheet toward a paper feed path 26. A separation roller 28 adapted to separate the paper sheet by sheet is disposed downstream from each of the paper feed roller 25 relative to the direction of conveyance of the paper.

On the paper feed path 26, multiple pairs of conveying rollers 27 are disposed. On a downstream end of the paper feed path 26 relative to the direction of conveyance of the paper, a pair of registration rollers 15 is disposed. The pair of registration rollers 15 is adapted to convey the sheets to the secondary transfer nip.

The manual paper feeder 9 includes a manual tray 29 on which sheets of paper are to be stacked, a paper feed roller 32 that feeds the sheets of paper from the manual tray 29 to a manual paper feed path 31, and a separation roller 33 that separates the paper sheet by sheet.

The fixing device 8 includes a fixing belt 34 stretched taut between two tension rollers, and a pressing roller 35 that presses against one of the tension rollers. The fixing belt 34 and the pressing roller 35 are in contact with each other to form a fixing nip therebetween. One of the tension rollers which is pressed against the pressing roller 35 contains a heat source so that the fixing belt 34 is heated.

The paper ejector 30 includes a pair of paper ejection rollers 36 that ejects sheets of paper and a paper ejection tray 37 on which the ejected sheets of paper are to be stacked.

The scanner 3 includes a first runner 38 and a second runner 39 each having a mirror, a contact glass 40, an imaging lens 41, and a reading sensor 42. The automatic document feeder 104 includes a document table 43.

A copy of a document is made as follows. In a case in which the document consists of a bunch of sheets, the bunch of sheets is placed on the document table 43 of the automatic document feeder 104. In a case in which the document consists of a book-like document having one-side binding, the document is placed on the contact glass 40. The contact glass 40 of the scanner 3 is exposed when the automatic document feeder 104 is opened. The book-like document having one-side binding is pressed against the contact glass 40 when the automatic document feeder 104 is closed.

Upon pressing of a start switch, the scanner 3 starts reading the document. In a case in which the document consisting of a bunch of sheets is placed in the automatic document feeder 104, the automatic document feeder 104 automatically feeds one of the sheets onto the contact glass 40 before the scanner 3 start reading the document. In reading the document, first, the first runner 38 and second runner 39 start moving and a light source contained in the first runner 38 starts emitting light. Light reflected from the document is further reflected by a mirror contained in the second runner 39. The light then passes through the imaging lens 41 and enters the reading sensor 42. The reading sensor 42 creates image information based on the entered light.

On the other hand, the imaging units 10Y, 10M, 10C, and 10K, intermediate transfer unit 6, secondary transfer device 7, and fixing device 8 start driving as well.

In the imaging units 10Y, 10M, 10C, and 10K, the photoreceptor 11 is driven to rotate counterclockwise in FIG. 3. The charger 12 then uniformly charges a surface of the photoreceptor 11 to a predetermined potential. The optical writing unit 5 emits laser light to the charged surface of the photoreceptor 11 based on the image information created by the reading sensor 42. The surface potential of the photoreceptor 11 decays upon exposure to the laser light and thus an electrostatic latent image is formed on the photoreceptor 11. Each of the photoreceptors 11 is exposed to the laser light based on single-color image information of yellow, magenta, cyan, or black. Each electrostatic latent image is developed into a toner image with toner particles supplied from each developing device 13.

In the intermediate transfer unit 6, the driving roller 18 is driven to rotate to make the intermediate transfer belt 16 rotate clockwise in FIG. 3. Each of the primary transfer bias rollers 21 is supplied with a constant-voltage-controlled or constant-current-controlled voltage having the opposite polarity to toner so that a transfer electric field is formed in the primary transfer nip defined between the primary transfer bias roller 21 and the photoreceptor 11. Toner images formed on the photoreceptors 11 are sequentially transferred onto the intermediate transfer belt 16 and superimposed on one another in the primary transfer nips by action of the transfer electric field. Thus, a full-color composite toner image is formed on a surface of the intermediate transfer belt 16. Residual toner particles remaining on the photoreceptor 11 without being transferred onto the intermediate transfer belt 16 are removed by the cleaner 14. The surface of the photoreceptor 11 from which residual toner particles have been removed is neutralized by a neutralizer. Thus, the photoreceptor 11 is returned to the initial state.

Almost at the same time as the document reading operation is initiated, paper feeding operation is initiated in the paper feeder 2. In the paper feeding operation, one of the paper feed roller 25 is rotated to feed sheets of paper from one of the paper feed cassettes 24. The separation roller 28 separates and feeds the paper, sheet by sheet, to the paper feed path 26. The pairs of conveying rollers 27 convey each sheet toward the secondary transfer nip. Alternatively, sheets of paper are fed from the manual tray 29. In this case, the paper feed roller 32 is rotated to feed sheets of paper from the manual tray 29. The separation roller 33 separates and feeds the paper, sheet by sheet, to the manual paper feed path 31.

A sheet fed from the paper feed cassettes 24 or manual tray 29 is then fed to the secondary transfer nip as the pair of registration rollers 15 rotates in synchronization with an entry of the full-color composite toner image on the intermediate transfer belt 16 to the secondary transfer nip. One of the tension rollers 22 which is facing the secondary transfer backup roller 19 is supplied with a transfer voltage having the opposite polarity to toner so that a transfer electric field is formed in the secondary transfer nip. The full-color composite toner image is transferred onto the intermediate transfer belt 16 in the secondary transfer nip by action of the transfer electric field. Instead of supplying one of the tension rollers 22 with a transfer voltage, sheets of paper may be charged by a non-contact charger. Residual toner particles remaining on the intermediate transfer belt 16 without being transferred onto the sheet are removed by the belt cleaner 20.

The sheet having the full-color composite toner image thereon is then fed from the secondary transfer nip to the fixing nip in the fixing device 8 as the paper conveying belt 23 rotates. In the fixing nip, the full-color composite toner image is applied with heat and pressure from the fixing belt 34 and pressing roller 35 and fixed on the sheet. The sheet is discharged from the fixing nip as the fixing belt 34 and pressing roller 35 rotate. The sheet is further discharged from the image forming apparatus as the pair of paper ejection rollers 36 rotates and stacked on the paper ejection tray 37.

In the above-described embodiment, all the four imaging units 10Y, 10M, 10C, and 10K are brought into operation to form full-color images. In some embodiments, only two or three out of four imaging units 10Y, 10M, 10C, and 10K may be brought into operation to form two-color or three-color images.

When two or more of the imaging units 10Y, 10M, 10C, and 10K are brought into operation to form two-color or multicolor images, the intermediate transfer belt 16 is stretched such that an upper stretched surface gets nearly horizontal and all the photoreceptors 11 are brought into contact with the upper stretched surface. When only the black imaging unit 10K is brought into operation to form black-and-white images, the intermediate transfer belt 16 is given a tilt downward to the left in FIG. 3 so that the photoreceptors 11 in the imaging units 10Y, 10M, and 10C are drawn away from the upper stretched surface of the intermediate transfer belt 16. Only the black photoreceptor 11K is rotated to form a black toner image. Thus, during formation of black-and-white images, the photoreceptors 11Y, 11M, and 11C and their peripheral devices (e.g., developing device 13) stop operation, which prevents unnecessary wear of photoreceptors and developer.

Figure 4:
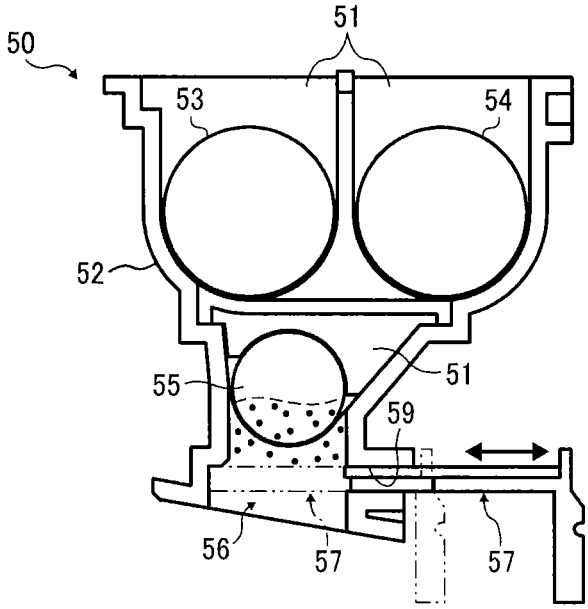
FIG. 4 is a cross-sectional side view of a toner supply device according to an embodiment.

FIG. 4 is a cross-sectional side view of a toner supply device according to an embodiment. A toner supply device 50 includes a casing 52 defining a toner container 51 for containing toner particles; three agitators 53, 54, and 55 for agitating toner particles contained in the toner container 51; and a shutter member 57 for opening and closing a discharge aperture 56 provided on the casing 52.

An aperture 59 is formed on a lower side wall surface of the casing 52. The shutter member 57 is let into the casing 52 through the aperture 59. The shutter member 57 is movable between a closed position (shown by two-dot chain lines in FIG. 4) at which the discharge aperture 56 is closed by insertion of the shutter member 57 into the casing 52 and an opened position (shown by solid lines in FIG. 4) at which the discharge aperture 56 is opened. The shutter member 57 is biased by a biasing force from a biasing member so as to be movable toward the closed position. In a case in which no force acts against the biasing force, the shutter member 57 is fixed at the closed position and the discharge aperture 56 is kept closed.

The toner supply device 50 is detachably mountable on an image forming apparatus. More specifically, the toner supply device 50 is detachably attachable to a developing device included in the image forming apparatus.

Figure 5:
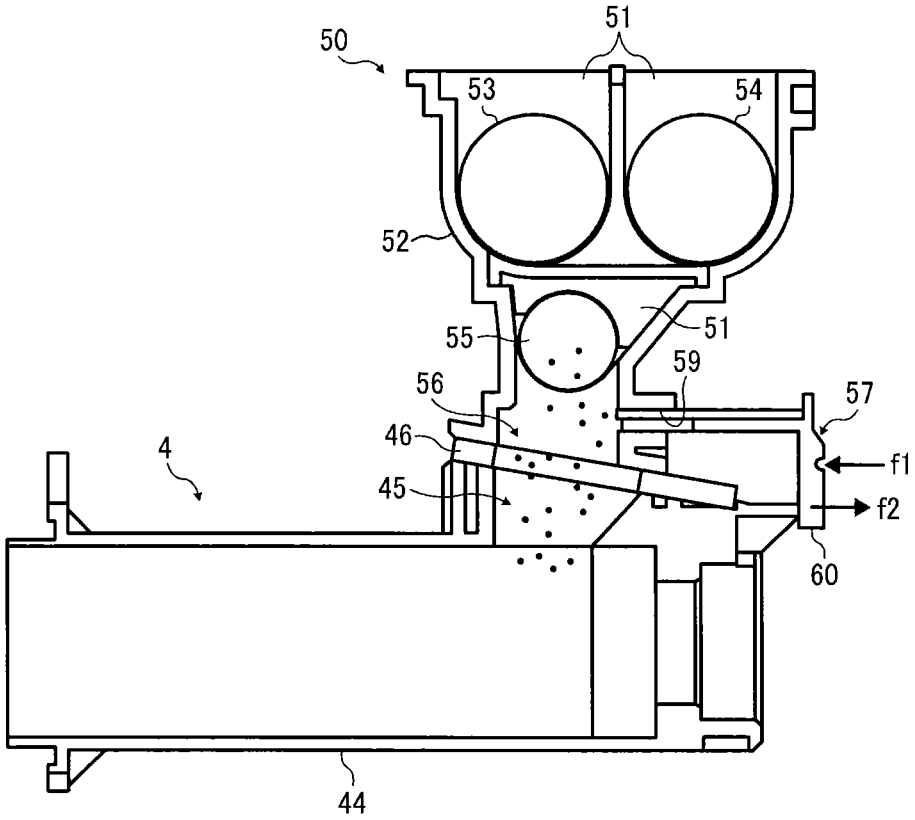
FIG. 5 is a cross-sectional side view of the toner supply device and a developing device attached to each other.
Figure 6:
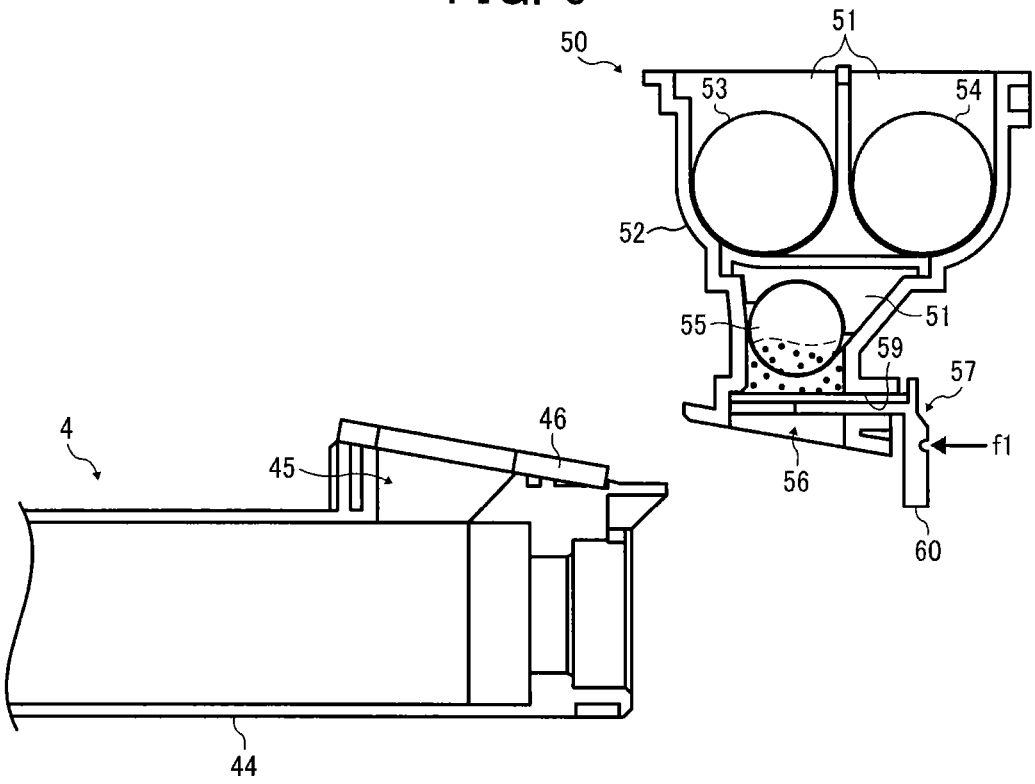
FIG. 6 is a cross-sectional side view of the toner supply device and the developing device detached from each other.

FIG. 5 is a cross-sectional side view of the toner supply device 50 and a developing device 4 attached to each other. FIG. 6 is a cross-sectional side view of the toner supply device 50 and the developing device 4 detached from each other.

Referring to FIG. 5, the toner supply device 50 is attached to an upper part of the developing device 4. More specifically, the discharge aperture 56 on a lower part of the toner supply device 50 is connected to a supply aperture 45 on an upper part of a developing casing 44 of the developing device 4. The shutter member 57 is biased with a biasing force f1 from a biasing member. When a contact part 60 of the shutter member 57 is brought into contact with the developing casing 44, a force f2 acts against the biasing force f1 and the shutter member 57 is moved to the opened position. As a result, the discharge aperture 56 is opened and toner particles get dischargeable from the toner container 51 to the developing device 4 through the discharge aperture 56.

In the above-described embodiment, the shutter member 57 is movable to the opened position by bringing the contact part 60 into contact with the developing casing 44. Alternatively, in some embodiments, the contact part 60 is brought into contact with another member provided on the main body of the image forming apparatus, such as a frame.

The edge of the supply aperture 45 is provided with a connecting seal 46. The supply aperture 45 and the discharge aperture 56 are connected to each other with the connecting seal 46 therebetween. The connecting seal 46 prevents leakage and scatter of toner particles from the connection between the supply aperture 45 and discharge aperture 56 during attachment of the toner supply device 50 to the developing device 4.

Referring to FIG. 6, when the toner supply device 50 is detached from the developing device 4, the contact part 60 gets free from the developing casing 44 and the shutter member 57 is moved to the closed position by action of the biasing force f1 from the biasing member. As a result, the discharge aperture 56 is closed with the shutter member 57 and toner particles are prevented from discharging from the discharge aperture 56.

Figure 7:
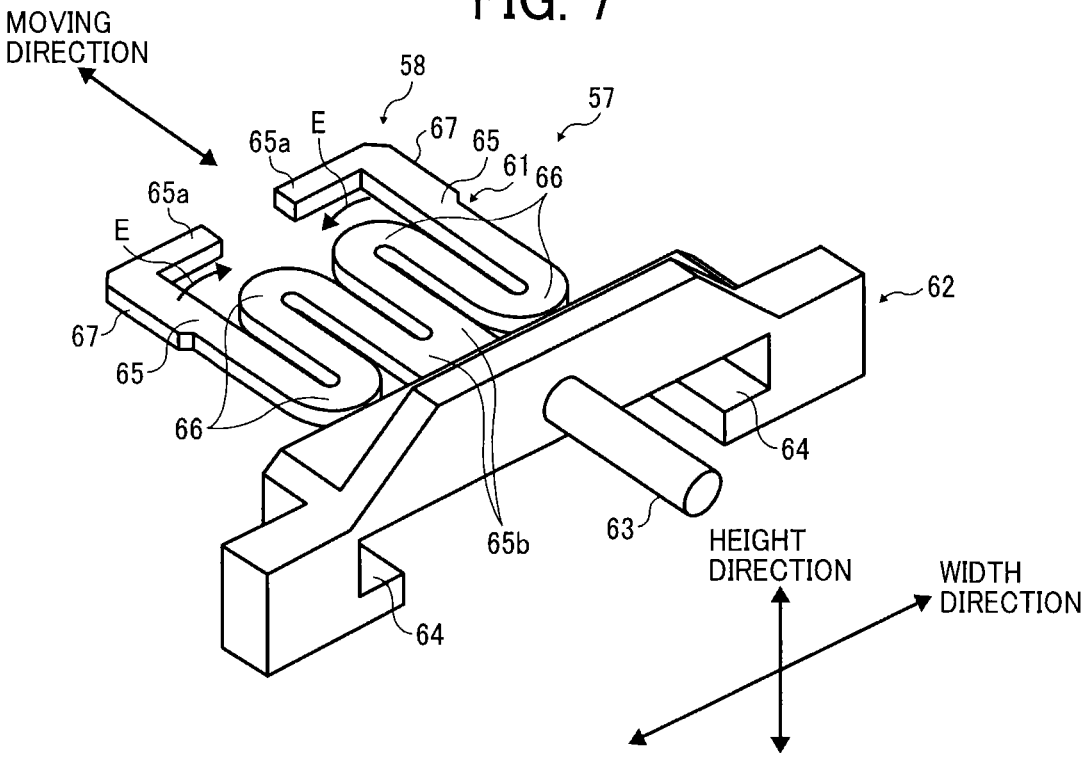
FIG. 7 is a perspective view of a shutter member included in the toner supply device.

FIG. 7 is a perspective view of the shutter member 57. The shutter member 57 includes a main body 58, and two seal members and one film member, to be described in detail later.

The main body 58 includes an elastic part 61 being elastically deformable and a base part 62 supporting the elastic part 61. The base part 62 is provided with a projection 63. The projection 63 is attachable to a coil spring serving as the biasing member. The base part 62 has a pair of guide portions 64. The pair of guide portions 64 is slidably attachable to a pair of rails provided to the casing 52. The shutter member 57 moves between the opened and closed positions as the pair of guide portions 64 slides on the rails.

The elastic part 61 has a pair of arm portions 65. The arm portions 65 are integrally connected to each other at the central part of the shutter member 57 with respect to the width direction. Each of the arm portions 65 extends outward in the width direction from a base end portion 65*b* while meandering, and further bends inward in the width direction so that a leading end portion 65*a* faces inward. Each meandering portion of each arm portion 65 has two U-shaped bending portions 66 being elastically deformable.

When the arm portion 65 receives an external force in the width direction from outward to inward, the arm portion 65 elastically deforms such that the leading end portion 65*a* moves inward in the width direction as shown by arrow E in FIG. 7. According to an embodiment, the arm portion 65 employs a plate spring which has proper stiffness to be elastically deformable in the width direction but poorly deformable in the height direction.

Figure 8:
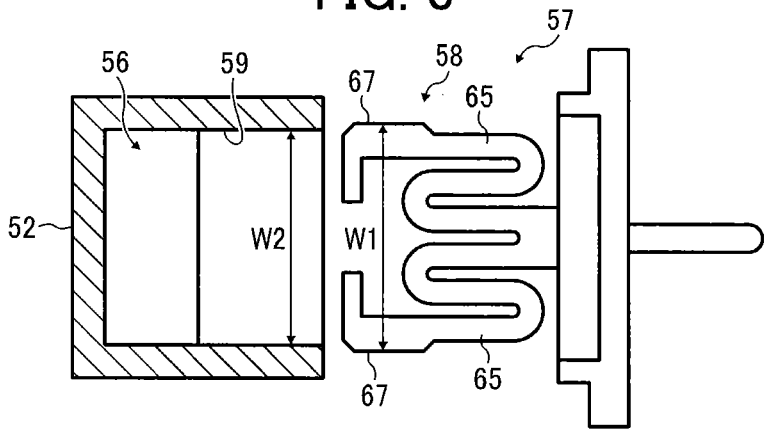
FIG. 8 is a cross-sectional plan view of the shutter member not yet inserted into a main body of the toner supply device.
Figure 9:
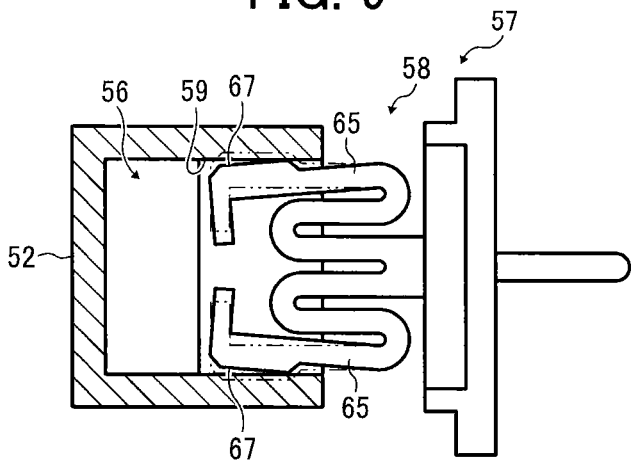
FIG. 9 is a cross-sectional plan view of the shutter member inserted into the main body of the toner supply device.

Each arm portion 65 has a convex portion 67 on a side surface facing outward in the width direction near the leading end portion 65*a*. As illustrated in FIG. 8, a width W1 between the pair of convex portions 67 is greater than a width W2 of the aperture 59. When the pair of arm portions 65 elastically deforms in the width direction as illustrated in FIG. 9, the main body 58 is allowed to let into the aperture 59.

Figure 10:
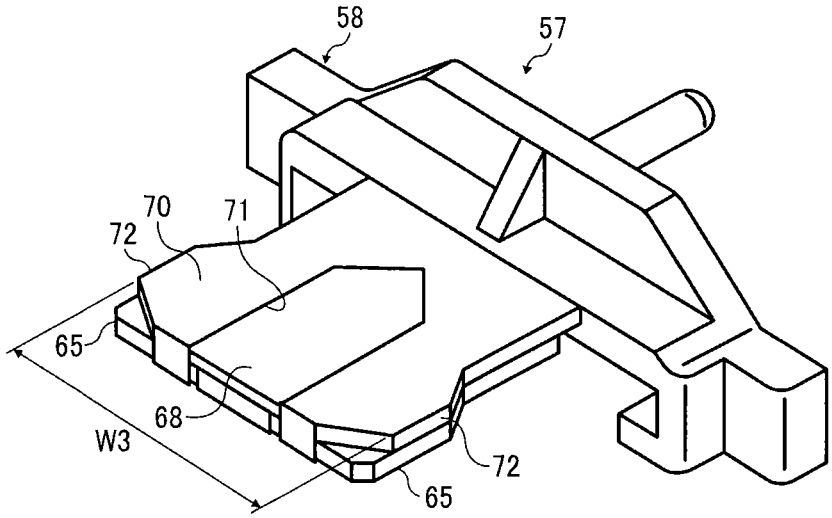
FIG. 10 is a perspective view of the shutter member.
Figure 11:
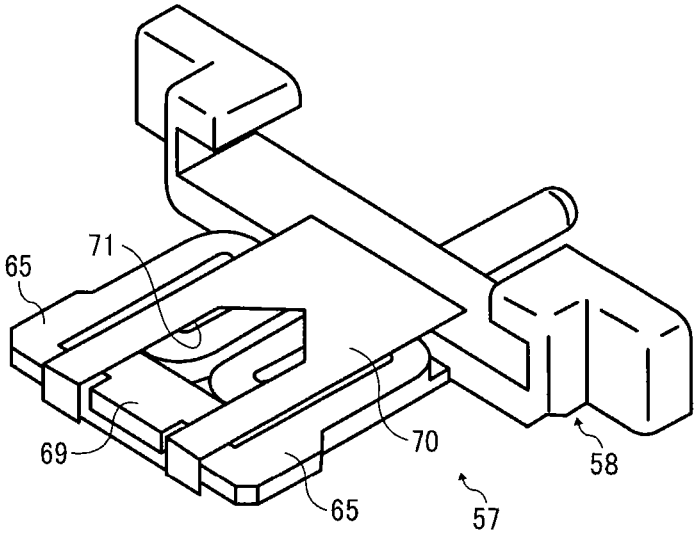
FIG. 11 is a bottom perspective view of the shutter member.

FIG. 10 is a perspective view of the shutter member 57. FIG. 11 is a bottom perspective view of the shutter member 57. The main body 58 includes two seal members, i.e., a first seal member 68 provided on an upper surface of the pair of arm portions 65 as illustrated in FIG. 10, and a second seal member 69 provided between the arm portions 65 as illustrated in FIG. 11. According to an embodiment, the seal members 68 and 69 are comprised of elastic members such as sponge.

The main body 58 further includes a film member 70 that covers over the upper surface of the first seal member 68, as illustrated in FIG. 10, and the lower surfaces of the pair of arm portions 65 and second seal member 69, as illustrated in FIG. 11. According to an embodiment, the film member 70 is comprised of a material having high slidability. The film member 70 has a cutout 71 at the central part thereof with respect to the width direction.

Referring to FIG. 10, the first seal member 68 has a pair of protruding portions 72 protruding outward in the width direction near its leading end. A width W3 between the pair of protruding portions 72 is greater than the width W2 of the aperture 59.

Figure 12:
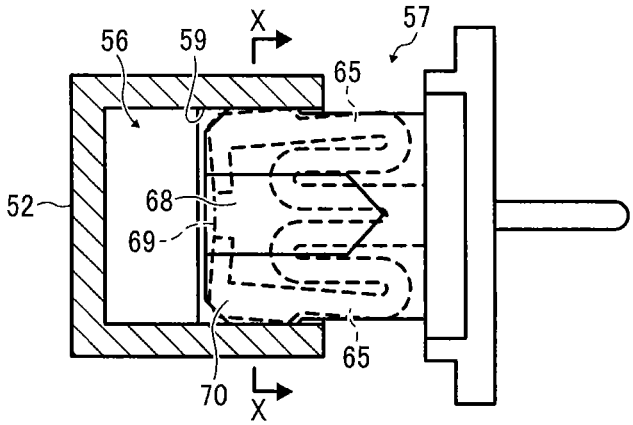
FIG. 12 is a cross-sectional plan view of the shutter member at the opened position.

FIG. 12 is a cross-sectional plan view of the shutter member 57 at the opened position. When the discharge aperture 56 is opened as illustrated in FIG. 12, toner particles are supplied from the toner supply device 50 to the developing device 4. At this time, the aperture 59 is hermetically sealed with the shutter member 57 at the opened position so as to prevent leakage of toner particles therefrom.

Figure 13:
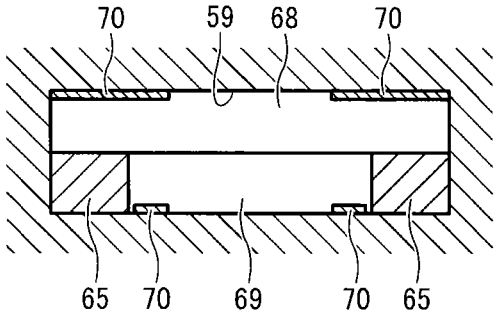
FIG. 13 is a cross-sectional view taken along a line X-X in FIG. 12.

FIG. 13 is a cross-sectional view taken along a line X-X in FIG. 12. As illustrated in FIG. 13, when the shutter member 57 is at the opened position, the aperture 59 is hermetically sealed with the pair of arm portions 65 and the seal members 68 and 69. Upon insertion of the pair of arm portions 65 into the aperture 59, the arm portions 65 elastically deform inward in the width direction, as illustrated in FIG. 9, and are brought into intimate contact with both side wall surfaces of the casing 52 due to generation of repulsive force against the elastic deformation. Thus, the aperture 59 can be hermetically sealed with the arm portions 65.

As the arm portions 65 deform inward in the width direction, the second seal member 69 provided between the arm portions 65 is compressed in the width direction. Thus, the second seal member 69 is brought into intimate contact with the arm portions 65. The space defined between the arm portions 65 is hermetically sealed with the second seal member 69.

Since the width W3 of the first seal member 68 is greater than the width W2 of the aperture 59, the first seal member 68 is compressed in the width direction upon insertion of the shutter member 57 into the aperture 59, as illustrated in FIG. 13. Thus, the first seal member 68 is brought into intimate contact with both side wall surfaces of the aperture 59. The aperture 59 is hermetically sealed with the first seal member 68.

Additionally, in FIG. 13, both the first and second seal members 68 and 69 are compressed in the vertical direction. Thus, the seal members 68 and 69 and the arm portions 65 are in intimate contact with each other in the vertical direction. These members are also in intimate contact with the upper and lower surfaces of the aperture 59. The aperture 59 is hermetically sealed with these members in the vertical direction as well as in the width direction.

Figure 14:
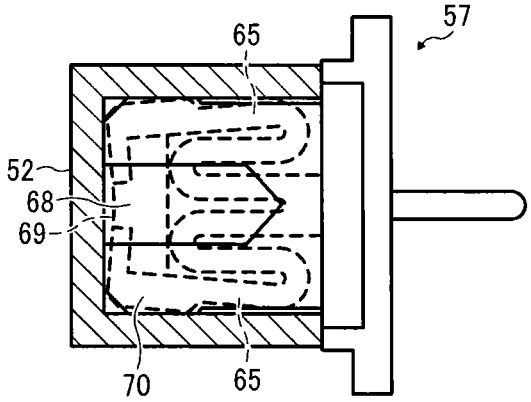
FIG. 14 is a cross-sectional plan view of the shutter member at the closed position.

FIG. 14 is a cross-sectional plan view of the shutter member 57 at the closed position. When the shutter member 57 is at the closed position, the discharge aperture 56 is closed with the shutter member 57 and leakage and scatter of toner particles from the discharge aperture 56 are prevented.

In summary, the pair of arm portions 65, which is elastically deformable in the width direction, allows the shutter member 57 to be easily inserted into the aperture 59 while reliably sealing the aperture 59. Because of having the convex portions 67, the arm portions 65 are brought into contact with inner wall surfaces of the casing 52 at small areas, which reduces frictional force generated between the shutter member 57 and the casing 52 upon insertion of the shutter member 57 into the casing 52. Thus, the shutter member 57 is given an improved movability between the opened and closed positions.

Figure 15:
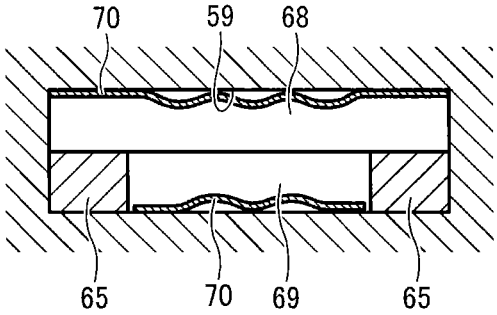
FIG. 15 is a cross-sectional view taken along a line X-X in FIG. 12 in a case in which a film member has no cutout.

The film member 70 is adapted to protect the surface of the shutter member 57 and to improve slidability of the shutter member 57 through the aperture 59. The cutout 71 provided at the central part of the film member 70 is adapted to absorb flexure of the film member 70 in the width direction. If the cutout 71 is not provided, the film member 70 may undulate, as illustrated in FIG. 15, resulting in formation of gaps between the film member 70 and inner wall surfaces of the aperture 59, through which toner particles are allowed to leak. Thus, the cutout 71 prevents undulation of the film member 70 and toner leakage.

Figure 2:
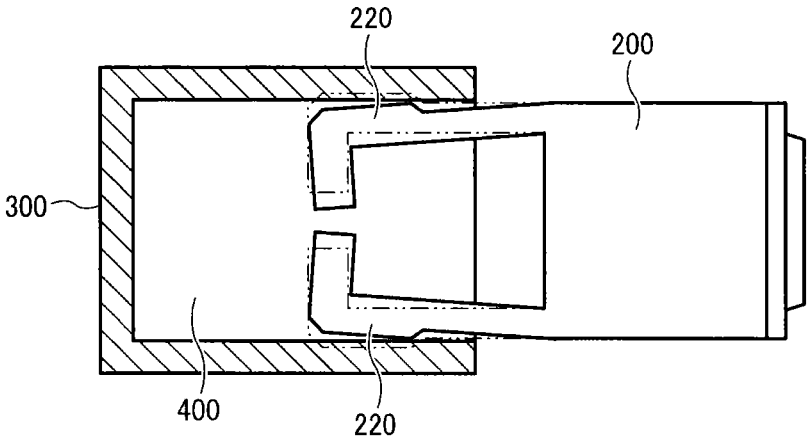
FIG. 2 RELATED ART
FIG. 2 is a plan view of the related-art toner supply device illustrated in FIG. 1.

The length of the arm portion 65 is greater than that of the arm portion 220 of the related-art shutter member illustrated in FIG. 2 because of having two U-shaped bending portions 66. When the arm portions 65 undergo elastic deformation as the shutter member 57 is inserted into the casing 52 through the aperture 59, stress does not concentrate on the arm portions 65 because the distance between the points of support and effort is relatively long with respect to each arm portion 65. Thus, the arm portions 65 are prevented from undergoing plastic deformation even when the arm portions 65 have been exposed to the elastic deformation for an extended period of time.

Figure 16:
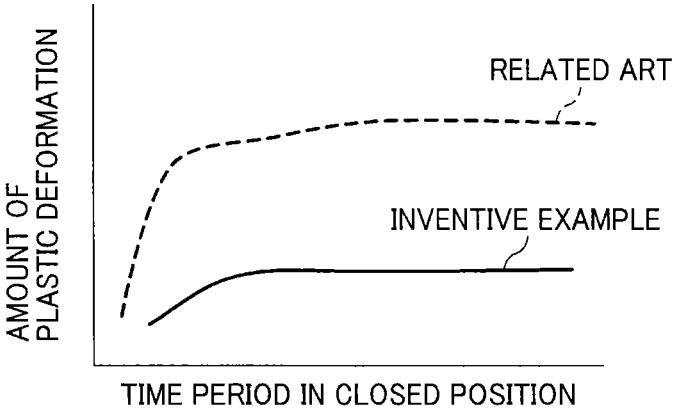
FIG. 16 is a graph showing the amount of plastic deformation of shutter members in closed positions.

FIG. 16 is a graph showing the amount of plastic deformation of shutter members in closed positions. Referring to FIG. 16, when the related-art shutter member is left at the closed position with being exposed to load stress for an extended period of time, the arm portion undergoes significant plastic deformation due to concentration of the stress thereto, which results in deterioration of sealing ability of the shutter member. By contrast, with respect to the inventive shutter member according to an embodiment, the arm portion undergoes plastic deformation only slightly even when being left at the closed position with being exposed to load stress for an extended period of time. Thus, the shutter member according to an embodiment can keep high sealing ability even at the opened position as well as at the closed position. The shutter member according to an embodiment is prevented from undergoing plastic deformation while keeping high sealing ability.

In the above-described embodiment, each of the arm portions 65 has two bending portions 66. However, the number of bending portions 66 provided to each arm portion 65 is not limited to any particular number. The arm portion 65 is prevented from undergoing plastic deformation when at least one bending portion 66 is provided thereto.

Additional modifications and variations in accordance with further embodiments of the present invention are possible in light of the above teachings. It is therefore to be understood that within the scope of the appended claims the invention may be practiced other than as specifically described herein.

What is claimed is:

1. A toner supply device, comprising:

a casing, the casing including:

a toner container for containing toner;

a discharge aperture for discharging the toner from the toner container; and an aperture; and a shutter member, the shutter member including:

an elastic part having at least two bending portions between a point of attachment of the bending portion and a point of contact of the bending portion and the casing, the elastic part being elastically deformable, wherein the shutter member is insertable into the casing through the aperture to be movable between a closed position at which the discharge aperture is closed and an opened position at which the discharge aperture is opened while the elastic part is kept elastically deformed.

2. The toner supply device according to claim 1, wherein the elastic part further has a pair of arm portions each having at least two of said bending portions, and wherein the arm portions are brought into contact with opposing inner surfaces of the casing when the shutter member is inserted into the casing through the aperture.

3. The toner supply device according to claim 2, wherein the arm portions include plate springs.

4. The toner supply device according to claim 2, wherein each of the arm portions has a convex portion which is the point of contact, and wherein the convex portion of each arm is brought into contact with a corresponding inner surface of the casing when the shutter member is inserted into the casing through the aperture.

5. The toner supply device according to claim 1, wherein the shutter member further includes a seal to seal a gap formed between the elastic part and the aperture when the shutter member is inserted into the casing through the aperture.

6. The toner supply device according to claim 5, wherein the shutter member further includes a film member covering a surface of the seal member, and the film member has a cutout at a central part thereof in a width direction of elastic deformation of the elastic part.

7. The toner supply device according to claim 1, further comprising a biasing member adapted to apply a biasing force to the shutter member to move the shutter member to the closed position.

8. The toner supply device according to claim 7, wherein the shutter member further includes a contact part, and wherein the shutter member is moved to the opened position when the contact part is brought into contact with a part of an image forming apparatus and receives a force against the biasing force therefrom.

9. An image forming apparatus, comprising:

a latent image bearing member adapted to bear a latent image;

a developing device adapted to develop the latent image into a toner image with toner; and the toner supply device according to claim 1 to supply toner to the developing device.

* * * * *